United States Patent [19]

Bragg

[11] Patent Number: 4,663,877

[45] Date of Patent: May 12, 1987

[54] SHOULDER FIREARM RECOIL ABSORBING MECHANISM

[76] Inventor: Elmore J. Bragg, 10125 NE. Glisan, Portland, Oreg. 97220

[21] Appl. No.: 801,677

[22] Filed: Nov. 25, 1985

[51] Int. Cl.[4] ..... F41C 23/00

[52] U.S. Cl. ..... 42/74; 42/71.01; 42/73

[58] Field of Search ..... 42/71.01, 73, 74

[56] References Cited

U.S. PATENT DOCUMENTS

| | | | |
|---|---|---|---|
| 1,032,628 | 7/1912 | Sherman | 42/74 |
| 1,307,529 | 6/1919 | Werndl | 42/74 |
| 1,328,700 | 1/1920 | Wagoner | 42/74 |
| 2,100,514 | 11/1937 | Miller et al. | 42/74 X |
| 3,019,543 | 2/1962 | Ducharme | 42/74 |
| 3,176,424 | 4/1965 | Hoge | 42/74 |
| 3,209,482 | 10/1965 | Kuzma et al. | 42/74 |
| 3,233,354 | 2/1966 | Ahearn | 42/74 |
| 3,707,797 | 1/1973 | Ruth | 42/74 |
| 3,754,344 | 8/1973 | Spiliotis | 42/74 |
| 4,120,108 | 10/1978 | Vickers et al. | 42/74 |
| 4,122,623 | 10/1978 | Stice | 42/73 |
| 4,203,244 | 5/1980 | Hickman | 42/73 |
| 4,439,943 | 4/1984 | Brakhage | 42/74 |

*Primary Examiner*—Deborah L. Kyle
*Assistant Examiner*—Ted L. Parr
*Attorney, Agent, or Firm*—Kenneth S. Klarquist

[57] ABSTRACT

A firearm employs a gun recoil apparatus wherein the comb portion of the stock is fixed relative to a butt end plate. The stock includes a base portion movable with respect to the comb portion. The base portion has at least one guide bore therein which extends longitudinally with respect to the base portion. The butt end plate includes at least one guide rod affixed thereto which is received and slidable within the guide bore. Means are included for fixedly securing the comb portion of the stock to the guide rod whereby the base portion can, upon firing, move relative to the comb portion and butt end plate. Means are provided for adjusting the height of the comb portion above the base portion.

6 Claims, 4 Drawing Figures

FIG. 1
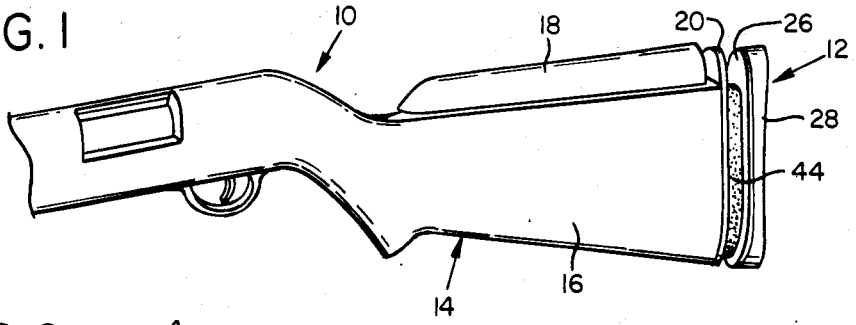
FIG. 2
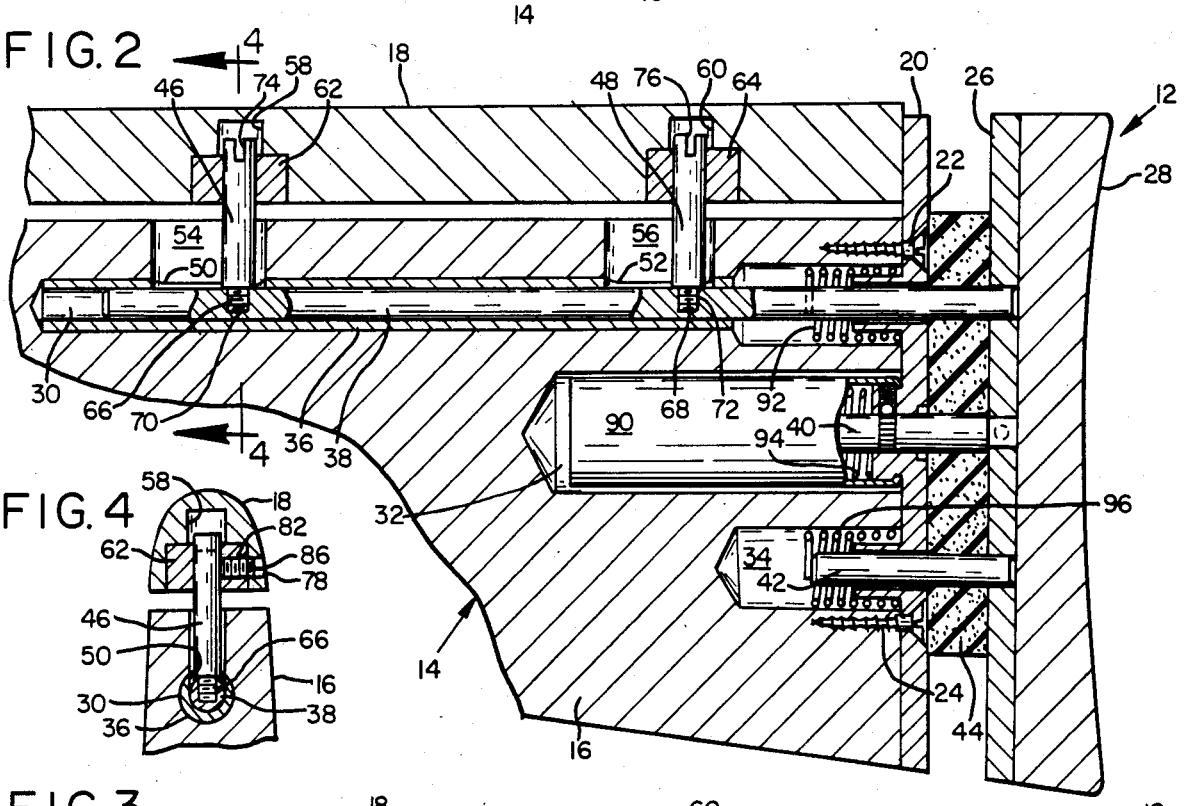
FIG. 4
FIG. 3
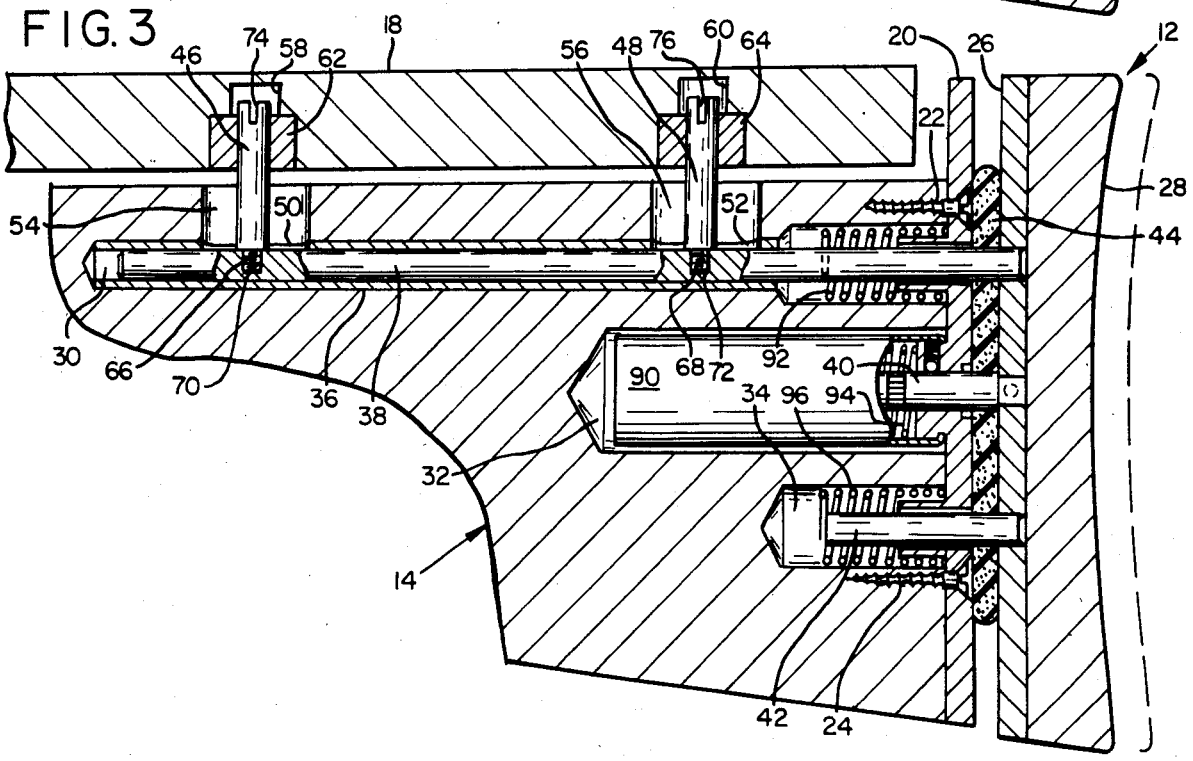

SHOULDER FIREARM RECOIL ABSORBING MECHANISM

FIELD AND BACKGROUND OF THE INVENTION

The present invention relates to a recoil device useful to buffer or dampen the reaction experienced by a shooter upon firing a shoulder firearm.

Gun recoil is experienced when using virtually any firearm. Recoil from such firearms can cause the shooter to flinch, raise his or her head, and/or causes the muzzle to flip up. Such movements generally result in reduced accuracy in the shot. Accordingly, it is desirable to reduce this recoil effect and thereby improve shot accuracy.

Recoil devices are well known in the art, for example, as shown in U.S. Pat. Nos. 1,328,700 to Wagoner; 3,019,543 to Ducharme; 1,307,529 to Werndl; 3,707,797 to Ruth; and 3,754,344 to Spiliotis. Each of these patents discloses a shoulder firearm having a recoil reducer which includes a butt end plate dampingly connected to the butt end of the firearm stock by at least one shaft member extending from the butt plate to the firearm's stock. Gun recoil in each of the firearms is damped by compressible springs. Upon firing, the gun stock slides rearward towards the end plate, compressing the springs which dampen the recoil effect.

Each of the mechanisms disclosed in these patents has the drawback that the comb portion of the shoulder firearm, which rests against the cheek of a user, is movable with respect to the butt end piece. This means that upon recoil, the comb portion slides rearward against the user's cheek and it tends to cause the shooter to flinch.

U.S. Pat. No 3,209,482 to Kuzma et al. discloses a recoil device for a shoulder firearm including a butt stock and a hollow butt plate assembly into which the butt stock can telescope. A shock absorbing assembly is provided between the butt stock and butt plate assembly. The butt plate assembly defines the comb to receive a user's cheek and thus would not slide on the cheek upon recoil of the gun barrel and butt stock. However, such device is relatively complex and includes a large number of components in order to function properly.

SUMMARY OF THE INVENTION

It is an object of the present invention to provide a new and improved shoulder firearm which isolates a user's shoulder and cheek from gun recoil.

A further object of the present invention is to provide a firearm having a recoil apparatus which, when installed on a shoulder firearm, is adaptable for different users.

A further object of the present invention is to provide a firearm having a recoil apparatus as above which is simple and easy to manufacture.

In accordance with the illustrated embodiment, the present invention comprises a firearm employing a gun recoil apparatus wherein the comb portion of the stock is fixed in position relative to the butt end plate so that the comb remains relatively stationary relative to a shooter's cheek when the firearm is fired. The stock includes a base portion fixed to the barrel and an upper comb portion movable with respect to the base portion. The base portion has at least one guide cylinder therein which extends longitudinally with respect to the base portion. The butt end plate includes at least one guide rod affixed thereto which is received and slidable within the guide cylinder. Means are included for fixedly securing the comb portion of the stock to the guide rod whereby the base portion can move relative to the comb portion and butt end plate. Means are also provided for adjusting the height of the comb relative to the base portion of the stock.

The foregoing and other objects, features and advantages of the invention will become more readily apparent from the following detailed description which proceeds with reference to the accompanying drawings.

DESCRIPTION OF THE DRAWINGS

FIG. 1 is a fragmentary perspective view of a firearm constructed in accordance with the invention.

FIG. 2 is an enlarged fragmentary longitudinal vertical section of the butt end of the stock of the firearm.

FIG. 3 is a view similar to FIG. 2 showing the mechanism in recoil position.

FIG. 4 is a sectional view taken along line 4—4 in FIG. 2.

DETAILED DESCRIPTION OF A PREFERRED EMBODIMENT

The invention to be described involves an adaptation of a recoil reducer sold by Danuser Machine Co. under U.S. Pat. No. 4,439,943 to a gun stock.

Referring to the drawings, indicated at 10 is a firearm such as a shotgun having a butt plate 12 and a stock portion 14. The stock portion 14 includes a lower base portion 16, an upper comb portion 18, and an end piece 20 secured to the end of the base portion 16 by mounting screws 22 and 24. The comb portion 18 is separate from the base portion 16 and end piece 20. The butt plate 12 includes a forward mounting plate 26 and a butt pad 28.

The base portion 16 of the stock 14 is formed with axially parallel bores 30, 32, and 34. The upper bore 30 extends into the base portion 16 a greater distance than do the bores 32 and 34 and is lined with a metal sleeve member 36. The sleeve 36 and bores 32 and 34 slidably receive guide rods 38, 40 and 42, respectively. The guide rods and bores are substantially parallel to the barrel of the firearm 10.

The guide rods 38, 40, 42 are fixedly secured to the mounting plate 26 of the butt plate 12. A compressible element 44 of sponge rubber or like material surrounds the guide rods in the space between the end piece 20 and mounting plate 26 to prevent dirt from getting onto the guide rods and into the bores.

Secured to the upper guide rod 38 are two dowel pins 46 and 48 which extend upwardly through slots 50 and 52, respectively, in the sleeve 36 and grooves 54 and 56 in the upper portion of the stock base portion 16 and into the comb portion 18. The pins 46 and 48 include lower threaded portions 66 and 68 respectively, which are threadedly received in threaded bores 70 and 72 in the upper portion of the guide rod 38. The upper portions of the pins 46 and 48 include rectangular slots 74 and 76 for receiving a blade screwdriver for torquing and thereby threadedly securing the pins 46 and 48 to the guide rod 38.

The comb portion 18 is provided with a pair of stepped bores 58 and 60 coaxial with the pins 46 and 48 in which are fixedly received a pair of metal sleeves 62 and 64 for slidably receiving the pins 46 and 48, respectively. The metal sleeves 62 and 64 are glued into the respective step bores with epoxy resin. Referring to FIG. 4, the comb portion 18 also includes horizontally extending bores 78 which extend from the outer side surface of the comb to each of the metal sleeves 62 and 64, each of which is provided with a threaded opening 82 for receiving a cooperatively threaded set screw 86. The set screws 86, when inwardly threaded and torqued, bear against the mounting pins 46 and 48 and secure them against vertical movement within the comb. Thus the height of the comb 18 relative to the base 16 can be adjusted by loosening the set screws 86 and raising or lowering the comb to the desired position and thereafter tightening the screws.

The guide rods extending from the butt plate 12 are dampingly received in the base portion in any suitable manner whereby gun recoil is reduced. As mentioned previously, the described embodiment utilizes a recoil reducer similar to that shown in U.S. Pat No. 4,439,943 to Brakhage. Such a reducer includes an oil filled damping mechanism 90 received in the central bore 32. Springs 92, 94, and 96 operatively secured to the rods 38, 40, 42 are provided in the bores 30, 32, and 34, respectively, for providing additional dampening effect. Reference is made to such patent for further details. Other reducers which provide a damping effect may also be used without departing from the principles and scope of the invention.

The operation of the device is best understood with reference to FIGS. 1, 2 and 3. In using the firearm, a user places the shoulder member 28 of the butt plate 12 against his or her shoulder and rests his or her cheek against the comb portion 18. Upon firing, gun recoil will force the base portion 16 of the stock rearward toward the butt plate 12 against the bias of the dampening mechanism 90 and springs 92–96. The butt plate 12 is restrained against movement since it bears against the user's shoulder. Since the comb portion 18 is fixed relative to butt plate 12, it will remain in fixed position and will not slide relative to the user's cheek. Accordingly, the user's cheek, resting against the comb portion, is not subjected to the recoil movement of the firearm. The user's shoulder and cheek are therefore isolated from firearm recoil whereby the tendency to flinch will be reduced substantially.

Having illustrated and described the principles of the invention with reference to a preferred embodiment, it should be apparent to those persons skilled in the art that such invention can be modified in arrangement and detail without departing from such principles.

I claim as my invention all such modifications as come within the true spirit and scope of the following claims;

1. A shoulder firearm comprising, an elongate stock including a base portion and an upper comb portion, the upper comb portion being movable longitudinally with respect to said base portion, said base portion having a guide bore therein extending longitudinally with respect to said base portion;

a butt plate;

a guide rod fixed to said butt plate and slidable within said guide bore;

two mounting pins threadedly mounted to said guide rod and extending upwardly therefrom, the mounting pins being slidably received in two elongate slots in the base portion which extend upwardly from the guide bore to the upper portion of the base, the mounting pins further being slidably received in respective vertical metal sleeve-lined bores in the comb portion;

the comb portion having horizontal bores extending from the outer side comb surface to the comb vertical bores, the metal sleeves lining the vertical bores each having a threaded bore axially aligned with the comb horizontal bores, threaded set screws being threadedly received in the metal sleeves which, when inwardly threaded and torqued, bear against the respective mounting pins whereby the comb portion is secured against vertical movement, whereby the height of the comb is adjustable relative to the guide rod and base portion, and whereby the base portion can move relative to the butt plate and comb portion.

2. A shoulder firearm comprising:

an elongate stock including a base portion and an upper comb portion, the upper comb portion being longitudinally movable with respect to the base portion, the base portion having a guide bore therein extending longitudinally with respect to the base portion;

a butt plate;

a guide rod fixed to the butt plate and slidable within the guide bore; and means for fixedly securing the comb portion to the guide rod whereby the base portion can move relative to the butt plate and comb portion, said means comprising two mounting pins secured to and upwardly extending from the guide rod into respective vertical bores in the comb portion and wherein an upper portion of the base includes two elongate slots which extend to the guide bore for slidably receiving the two mounting pins whereby axial movement of the base portion is permitted relative to the two mounting pins.

3. The shoulder firearm of claim 2, wherein the mounting pins are threadably received in the upper portion of the guide rod.

4. The apparatus of claim 2 wherein the position of said comb portion with respect to said mounting pins is adjustable vertically, and fastener means operatively arranged between said comb portion and said mounting pins for securing said comb portion in selected position on said pins.

5. A recoil apparatus for a shoulder firearm, the shoulder firearm including an elongate stock having a base portion and an upper comb portion, the upper comb portion being longitudinally movable with respect to the base portion, the base portion having a guide bore therein extending longitudinally with respect to the base portion, the firearm having a butt end piece separate from the comb portion and base portion, the recoil apparatus comprising, a guide rod adaptable to be slidably received in the guide bore;

means for fixedly securing the guide rod to the butt end piece; and means for fixedly securing the comb portion to the guide rod whereby the base portion can move relative to the butt end piece and comb portion, said means for fixedly securing the comb portion to the guide rod comprising a pair of mounting pins secured to and upwardly extending from the guide rod, the mounting pins adapted to be received in respective vertical bores in the comb portion.

6. The apparatus of claim 5 wherein the mounting pins are threadedly received in the upper portion of the guide rod.

* * * * *